US008480004B2

(12) United States Patent
Farrell

(10) Patent No.: US 8,480,004 B2
(45) Date of Patent: Jul. 9, 2013

(54) SYSTEM FOR DELIVERING WARMED FLUIDS

(75) Inventor: Christopher C. Farrell, Braunton (GB)

(73) Assignee: Zenex Technologies Limited, Exeter, Devon (GB)

( * ) Notice: Subject to any disclaimer, the term of this patent is extended or adjusted under 35 U.S.C. 154(b) by 1085 days.

(21) Appl. No.: 11/667,630

(22) PCT Filed: Oct. 20, 2005

(86) PCT No.: PCT/GB2005/004064

§ 371 (c)(1), (2), (4) Date: May 11, 2007

(87) PCT Pub. No.: WO2006/051259

PCT Pub. Date: May 18, 2006

(65) Prior Publication Data

US 2007/0295826 A1 Dec. 27, 2007

(30) Foreign Application Priority Data

Nov. 12, 2004 (GB) ..... 0425050.2
Jun. 29, 2005 (GB) ..... 0513320.2

(51) Int. Cl.
*F24D 3/08* (2006.01)
*F24D 17/00* (2006.01)

(52) U.S. Cl.
USPC ..... 237/2 A; 237/2 R; 237/8 A; 237/19; 237/62; 122/13.3; 122/14.22

(58) Field of Classification Search
USPC ..... 122/20 B, 421, 78, 142, 155.3, 20 R, 122/40, 13.3, 14.22; 237/19, 2 A, 2 R, 8 A, 237/62
IPC ..... F24D 3/08,17/00
See application file for complete search history.

(56) References Cited

U.S. PATENT DOCUMENTS 853,738 A * 5/1907 Ruud ..... 236/33
1,473,036 A * 11/1923 Greenham ..... 237/19

(Continued)

FOREIGN PATENT DOCUMENTS

EP 0356609 A1 3/1990
EP 0675326 A1 10/1995

(Continued)

OTHER PUBLICATIONS

Search Report from International Application No. PCT/GB2006/003756, mailed Jan. 15, 2007.

*Primary Examiner* — Steven B McAllister
*Assistant Examiner* — Daniel E Namay
(74) *Attorney, Agent, or Firm* — Wolf, Greenfield & Sacks, P.C.

(57) ABSTRACT

A fluid system is provided comprising: a heater having an inlet and an outlet; a storage vessel; storage vessel heating means for heating the fluid in the storage vessel; a mixing valve having a first inlet for receiving fluid to be heated from a fluid supply, a second inlet for receiving fluid from the storage vessel, and an outlet for supplying fluid to the inlet of the heater; and a controller wherein the controller is arranged to monitor the heater's performance and to operate the mixing valve to blend the fluid from the fluid supply with fluid from the storage vessel, for example, when a demand on the heater exceeds a threshold value.

12 Claims, 4 Drawing Sheets

U.S. PATENT DOCUMENTS

| | | | | | |
|---|---|---|---|---|---|
| 1,490,860 | A | * | 4/1924 | Smith et al. | 237/19 |
| 1,633,759 | A | * | 6/1927 | Breese, Jr. | 236/20 R |
| 1,725,876 | A | * | 8/1929 | Luthe et al. | 122/14.22 |
| 1,790,353 | A | * | 1/1931 | Newell | 236/21 R |
| 2,051,240 | A | * | 8/1936 | Berryman | 290/2 |
| 2,233,050 | A | * | 2/1941 | Groeniger | 122/13.3 |
| 2,331,718 | A | * | 10/1943 | Newton | 126/101 |
| 2,424,844 | A | * | 7/1947 | Parry | 122/14.22 |
| 2,455,988 | A | * | 12/1948 | Fife | 237/2 R |
| 2,456,142 | A | * | 12/1948 | Osterheld | 392/464 |
| 2,513,045 | A | * | 6/1950 | Patrick et al. | 122/14.22 |
| 2,619,326 | A | * | 11/1952 | McLenegan | 165/240 |
| 3,086,710 | A | * | 4/1963 | Shimko | 237/2 R |
| 3,181,793 | A | * | 5/1965 | MacCracken et al. | 237/2 R |
| 3,241,763 | A | * | 3/1966 | MacCracken | 237/2 R |
| 3,383,495 | A | * | 5/1968 | Laube et al. | 392/450 |
| 3,515,123 | A | * | 6/1970 | Duncan | 122/14.22 |
| 3,522,909 | A | * | 8/1970 | Arant | 239/127 |
| 3,958,555 | A | * | 5/1976 | Horne | 122/13.3 |
| 4,090,474 | A | * | 5/1978 | Kauffmann | 122/20 B |
| 4,324,207 | A | * | 4/1982 | Leuthard | 122/14.22 |
| 4,350,144 | A | * | 9/1982 | Beckwith | 126/586 |
| 4,358,652 | A | | 11/1982 | Kaarup | |
| 4,966,127 | A | | 10/1990 | Martinez, Jr. | |
| 5,410,989 | A | | 5/1995 | Kendall et al. | |
| 5,626,287 | A | * | 5/1997 | Krause et al. | 236/20 R |
| 5,701,387 | A | * | 12/1997 | McGugan | 392/456 |
| 5,730,356 | A | * | 3/1998 | Mongan | 237/19 |
| 5,918,805 | A | | 7/1999 | Guyer | |
| 6,464,027 | B1 | * | 10/2002 | Dage et al. | 180/65.22 |
| 2002/0162735 | A1 | | 11/2002 | Newman | |
| 2003/0052181 | A1 | * | 3/2003 | Bolster | 237/2 A |
| 2003/0089399 | A1 | | 5/2003 | Acker | |
| 2003/0230300 | A1 | | 12/2003 | Luo | |
| 2004/0031858 | A1 | * | 2/2004 | Haklander et al. | 237/2 A |
| 2004/0041033 | A1 | * | 3/2004 | Kemp | 236/12.12 |
| 2004/0237557 | A1 | | 12/2004 | Harmon et al. | |
| 2005/0177281 | A1 | | 8/2005 | Caves et al. | |
| 2007/0034702 | A1 | | 2/2007 | Rixen et al. | |
| 2009/0090310 | A1 | | 4/2009 | Farrell | |

FOREIGN PATENT DOCUMENTS

| | | | | |
|---|---|---|---|---|
| EP | 1 039 236 | A | | 9/2000 |
| EP | 1039236 | | * | 9/2000 |
| GB | 2420174 | C | | 12/2006 |
| JP | 2005274055 | A | * | 10/2005 |

* cited by examiner

SYSTEM FOR DELIVERING WARMED FLUIDS

FIELD OF THE INVENTION

The present invention relates to a system for delivering warm fluids, for example a hot water system.

BACKGROUND OF THE INVENTION

The demand for hot water from a hot water system may vary considerably during the day. For a domestic system, there will be long period where no hot water is being drawn interspersed with much shorter periods where hot water is demanded, for example for showers or baths. Generally speaking, two alternative approaches to providing hot water are taken. The first approach, as shown in FIG. 1, is to use a boiler 2 to heat a tank of water 4 via a heat exchanger 6. Thus a relatively low capacity boiler is able to heat a reservoir of water within the tank 4 to an acceptably high temperature. When a user wishes to use the water, for example to run a bath, hot water is drawn off through an outlet pipe 8 at the top of the tank and cold water 10 is admitted to the bottom of the tank. Typically the cold water 10 comes from a separate header tank although in principle it can also come from direct connection to the cold main supplying the dwelling. In a domestic installation the boiler 2 may also have a heating hot water outlet and heating water return pipes 12 and 14, respectively, such that the boiler can heat the dwelling via a radiator system.

An alternative approach which is also common in domestic hot water and heating systems is the combination boiler as shown in FIG. 2. Here the store of preheated water is dispensed with and instead, when it is desired to use hot water, cold water is received by the boiler 20 directly from the cold water main 22 and is heated, in real time, within the boiler and output at a hot water outlet 24. The combination boiler 20 also has a heating water outlet and heating water return 12 and 14.

Each system has its own advantages and disadvantages. The system shown in FIG. 1 provides a plentiful supply of hot water, but once the water in the tank has been used, or rather exchanged with cold water, then there is a considerable delay before the water in the tank gets reheated to an acceptable temperature. The combination boiler system shown in FIG. 2 provides instantaneous supplies of hot water, but the flow rate of hot water is typically considerably restricted compared to the arrangement shown in FIG. 1.

These systems are also used on a commercial scale, for example in hospitals and leisure centres. In such arrangements there is generally a background level of substantially constant (mean) hot water usage, but otherwise similar considerations apply. Therefore, in order to satisfy the peak demand that is likely to be expected either large storage vessels are required such that the water in them can be heated when the boiler has a spare capacity to do so, or alternatively the boiler must be rated for the maximum expected demand and hence a larger and more expensive boiler system is required which generally runs at below its peak capacity.

SUMMARY OF THE INVENTION

According to a first aspect of the present invention there is provided a hot fluid system comprising:

a hot fluid heater having an inlet and an outlet;

a storage vessel;

storage vessel heating means for heating the fluid in the storage vessel;

a mixing valve having a first inlet for receiving fluid to be heated from a fluid supply, a second inlet for receiving fluid from the storage vessel, and an outlet for supplying fluid to the inlet of the fluid heater; and a controller;

wherein the controller is arranged to monitor the heater's performance and to operate the mixing valve to blend the fluid from the fluid supply with fluid from the fluid storage vessel for supply to the heater.

It is thus possible to provide a heating system, for example for water, in which warm water can be blended with cold water, typically from the cold main, to raise the water temperature at the inlet to a water heater. This reduces the temperature rise that the water heater needs to impart to the water in order to obtain a target temperature. Since the product of the temperature rise and the flow rate through the water heater is a constant once the water heater has reached its maximum heating capacity it follows that a higher flow rate through the water heater can be maintained while warm water is available from the water storage vessel.

By having a store of pre-warmed (or preheated) water, and by being able to control the rate at which the pre-warmed water is mixed with the cold main, it is possible to enable the water system to cope with short term high flow rate demands for hot water which would be well beyond the capability of the water heater to service if it received its water solely from the cold main.

Preferably the water heater is a combustion boiler, and most preferably is a "combination" boiler where heated water at the output of the boiler is intended for direct delivery to one or more hot taps.

Advantageously a flue gas heat recovery system is provided for recovering heat from the flue gases of the combustion boiler and this heat is used to warm the water in the water storage vessel. A heat exchanger may also be provided in the water vessel which is connected to the boiler output such that at times of low hot water demand the water heater can be used to raise the temperature of the water in the water storage vessel.

Advantageously the flue gas heat recovery system includes a storage system and the stored heat can be used to preheat the cold water passing through the flue gas heat recovery system, the water then entering the storage vessel when hot water is drawn off via a tap.

Preferably the mixer is a mixing valve. The action of the valve is responsive to an output of the controller.

The blending may be a function of the demand placed on the heater. Therefore at low flow rates a controller may determine that little or no warmed liquid should be mixed with the inlet supply as the temperature rise is well within the capacity of the heater alone. However, as the demand increases due for example to an increased flow rate, then the controller may increase the proportion of warmed liquid in the blend such that the temperature rise that needs to be achieved by the heater is reduced.

In an alternative embodiment, the valve may be operated so as to achieve a target water temperature for supply to the heater. In such an installation the valve may be a thermostatically controlled mixing valve.

According to a second aspect of the present invention there is provided a method of operating a liquid heating system, the heating system comprising: a heater having an inlet and an outlet; a storage vessel; storage vessel heating means for heating liquid in the storage vessel; a mixing valve having a first inlet for receiving liquid to be heated from a liquid supply, a second inlet for receiving liquid from the storage vessel, and an outlet for supplying liquid to the inlet of the heater, wherein the mixing valve is adopted to blend liquid from the liquid supply with liquid from the storage vessel.

BRIEF DESCRIPTION OF THE FIGURES

Embodiments of the present invention will further be described, by way of example, with reference to the accompanying drawings, in which.

DESCRIPTION OF PREFERRED EMBODIMENTS

Figure 1:
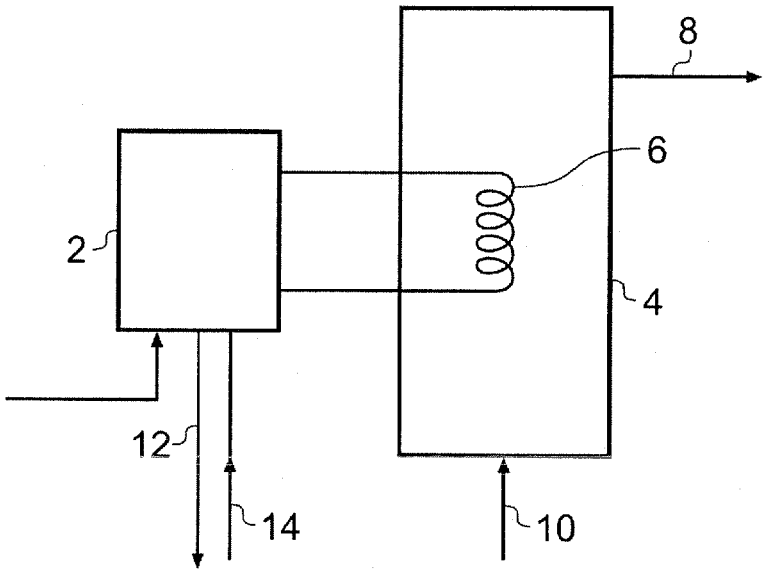
Fig. 1 PRIOR ART
FIG. 1 schematically illustrates a prior art hot water system having a hot water cylinder.
Figure 2:
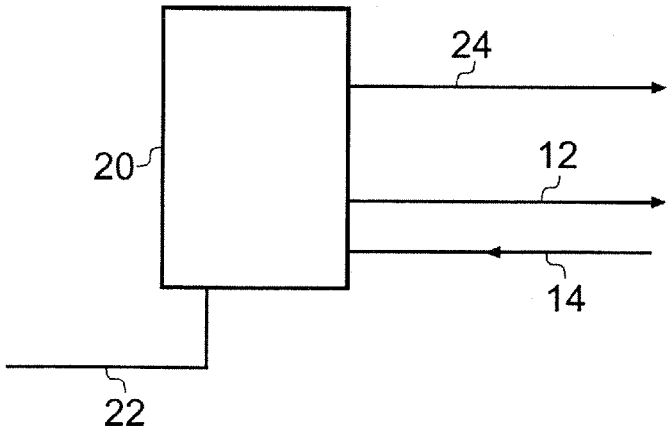
Fig. 2 PRIOR ART
FIG. 2 schematically illustrates a prior art hot water system utilising a combination boiler.
Figure 3:
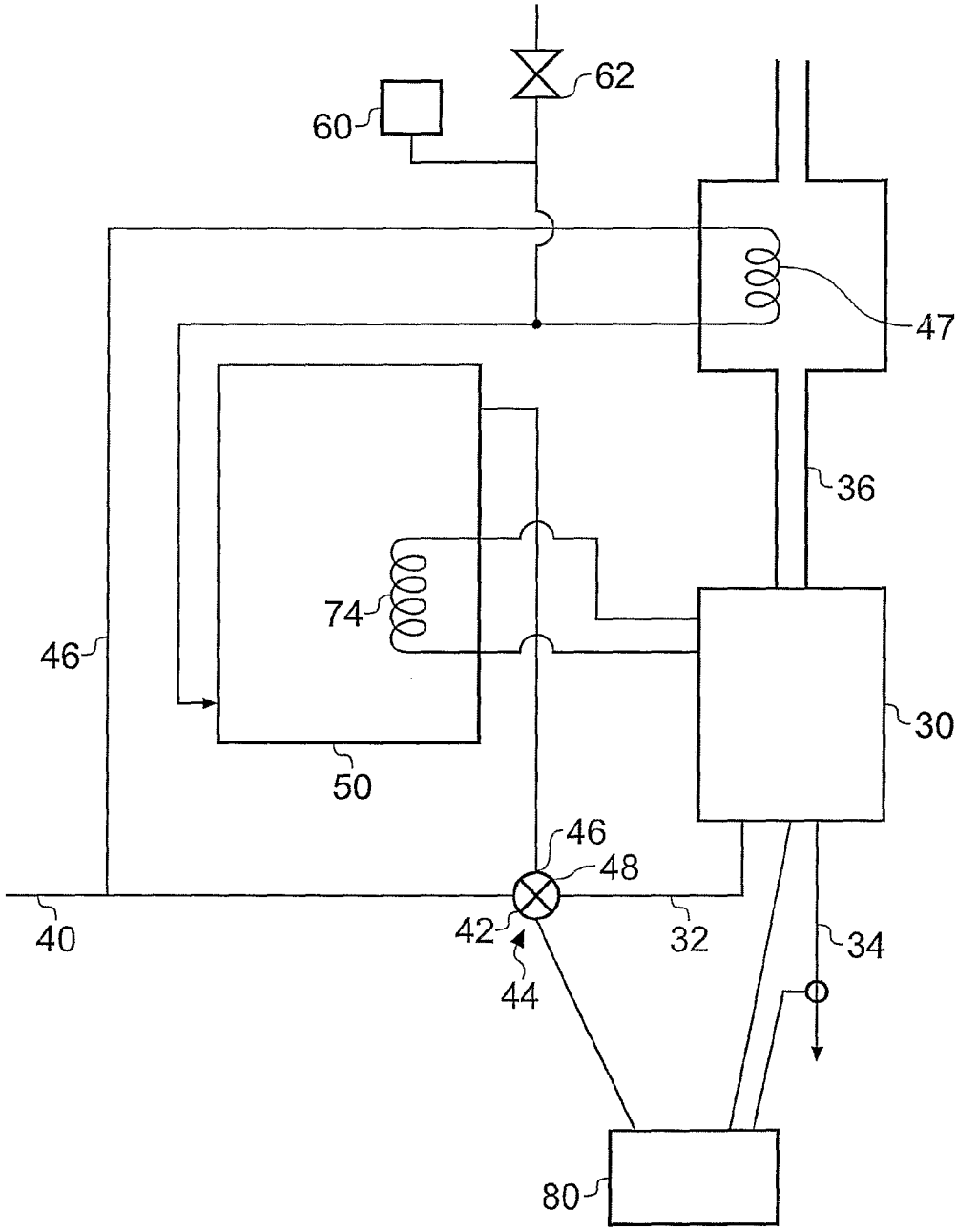
FIG. 3 schematically illustrates a hot water system constituting a first embodiment of the present invention.

FIG. 3 schematically illustrates an embodiment of the present invention. A water heater 30, which typically is a combination boiler, has a cold water inlet 32 and a hot water outlet 34. The boiler will also have a fuel supply inlet (not shown) and heating water out and return pipes for supplying a radiator based heating system (also not shown for clarity). In use the combination boiler 30 burns a fuel, such as gas, and the waste combustion gases are exhausted via a flue 36.

Cold water for heating by the boiler is supplied by a water source 40, which is typically a direct connection to the cold water main. It can be seen that the cold water can flow along two branches. A first cold water branch flows to a first input 42 of a controllable mixer or blending valve 44. A second cold water branch 46 flows from the cold water main 40, through a heat exchanger 47 and into a water storage vessel 50.

An outlet of water storage vessel 50 is provided to a second input 46 of the mixing valve 44. An output 48 of the mixing valve 44 is connected to the cold water input 32 of the combination boiler 30. The water storage vessel 50 is also connected to an expansion chamber 60 and a pressure relief valve 62 as is known to the person skilled in the art, so as to avoid pressure build up within the vessel, although these components may be omitted if back flow of water into the cold main is possible (and legal), thereby ensuring that the internal pressure within the water storage vessel 50 is the same as the cold mains pressure. Alternatively a vented tank fed from a header tank may be used.

The heat exchanger 47 is provided in the path of the hot flue gases such that water entering the water storage vessel from the cold main passes through the heat exchanger 47 and receives heat from the hot flue gas. A secondary heating coil 74 may also be provided such that the boiler itself can be used to heat the water in the storage vessel 50.

Figure 4:
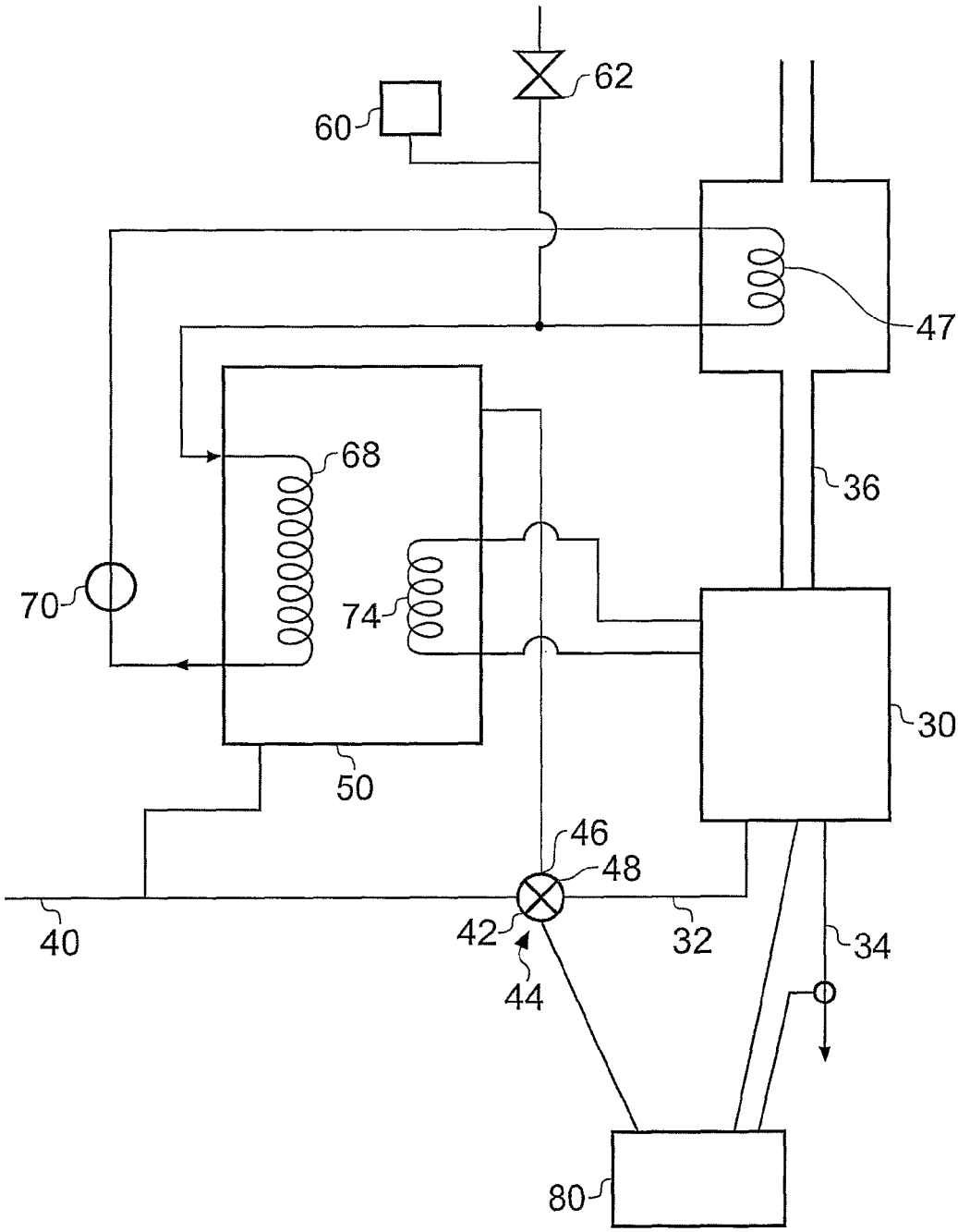
FIG. 4 schematically illustrates a hot water system constituting a second embodiment of the invention.

In an alternative configuration, shown in FIG. 4 the cold water main corrects directly to the water storage vessel 50 and the heat exchanger coil 47 is configured such that it delivers heat to the storage vessel 50. In this configuration, heat can be provided to the water in the storage vessel 50 via a further heat exchange coil 68. The water flow is driven by a pump 70. In this configuration heat can be delivered to the vessel all the time that the boiler 30 is combusting fuel. Additionally, a secondary heating coil 74 may be provided within the vessel 50 such that the boiler 30 can itself be used to warm water within the vessel 50. Typically a boiler may spend a considerable time in a standby mode or a space heating mode, and hence indirect heating of the water in the vessel 50 via the coils 74 and/or 68 should enable the water temperature inside the vessel 50 to achieve a temperature of 65° C.

In each embodiment, the blending valve 44 is responsive to a controller 80 which controls the position of the valve and hence the ratio of water directly from the cold main compared to water from the storage vessel 50 which is admitted to the boiler 30. The controller 80 may be an integral part of the boiler's controller or may be in communication with it in order to receive data concerning the boiler's performance, and in particular whether the boiler is operating at or near full capacity. The controller 80 may also receive data from temperature or flow rate sensors in the output line 34 although these sensors could be internal to the boiler and might already be provided for the use of the boiler controller.

When the boiler is operating in a heating mode, waste heat exiting through the flue gases is recovered by the heat exchanger 47. Where the recovery system 47 has a heat storage capability itself, for example as will be described later, then the configurations of FIG. 3 or 4 are equally appropriate. However if the heat exchanger 47 does not have its own heat storage capability, then the configuration shown in FIG. 4 is more appropriate and the recovered heat can be used to warm the water in the storage vessel 50.

The controller can work either to conserve the hot water in the vessel 50 to reserve it only for meeting peak loads, or it can be arranged to use the water from the vessel 50 whenever hot water is required. This is a design choice depending on the requirements of a particular installation.

Suppose initially that keeping the water to meet peak flow is the primary requirement. When the boiler is operating in a hot water mode, then the rate of water flow through the boiler is measured or inferred from the boiler's own controller and whilst the boiler is able to accept the demanded flow rate entirely from the cold water main and lift it to the desired temperature, then the controller 80 sets the mixing valve 44 such that all, or substantially all, of the water supplied to the boiler comes directly from the cold main. However, as the demanded rate of flow through the boiler increases, there will eventually become a point where the boiler is operating at its maximum capacity. It is assumed, at this stage, that the output temperature from the boiler is still at the target temperature. This flow rate depends, to some extent, on the temperature of the water coming in from the cold main 40. If the users of the system now demand more hot water then the product of the flow rate and the required temperature rise will exceed the capacity of the boiler and, in the prior art combination boiler systems, the hot water temperature at the output 34 would begin to fall. However in the present invention, the onset, or a near onset of this condition is detected by the controller 80 and the blending valve 44 is operated so as to admit some of the warmed water from the storage vessel 50. The mixing of the incoming cold main with some of the warmed water from the storage vessel 50 naturally causes an increase in the temperature of the water arriving at the boiler inlet 32 and consequently the temperature rise that needs to be imparted by the boiler is reduced. This means that the hot water system can service hot water demands where the flow rate is in excess of the capacity of the boiler to raise the water temperature at that flow rate from the cold main temperature to the desired output temperature on its own. Clearly this additional demand can only be serviced whilst there remains a store of warm water within the storage vessel 50. Once that store is depleted, then the temperature of the water entering the boiler returns to being that of the cold main temperature. However it can be seen that transient high demand conditions can be accommodated without degradation of the final output temperature from the hot water system. The duration for which these transient conditions can be serviced depends, primarily, to the size of the water store 50 and this is a free choice of the system designer. Suppose, for example, that a typical domestic combination boiler can raise ten liters of water per minute by 35° C. If the cold water main is at 10° C., then the ultimate hot water temperature at maximum flow rate is 45° C. Thus, if the user wanted to run a warm bath, they would be limited to filling the bath at 10 liters per minute. However, if in an embodiment of the present invention water in the storage vessel 50 has been previously heated to 50° (which is a reasonable target temperature) as flue gases may often be in this temperature range or higher, then this water can be mixed with the cold main. Therefore, if a user wishes to run a bath at a flow rate of 20 liters per minute and with a target temperature of 45° C., then we know that the boiler will only be able to achieve a temperature rise of 17.5°. This means that the water temperature at the inlet to the boiler must be raised to 27.5°. We can also see that if water from the hot water tank 50 is mixed with water from the cold water main at a ratio of 1:1, then the water temperature achievable at the inlet to the boiler is 30°. It can also be seen that, of the 20 liters per minute, 10 liters per minute would be derived directly from the cold main and 10 liters would be derived from the storage vessel 50. Thus, if the storage vessel had a size of 100 liters, then this enhanced flow rate of 20 liters per minute could be sustained for 10 minutes.

The system designer has a choice of whether to wait until the boiler has reached maximum capacity before starting to mix water into the cold water input, or whether the blending is started earlier, for example when the boiler reaches 80 or 90% of its maximum capacity depending on considerations of boiler efficiency and the like. Similarly the controller 80 could merely be responsive to the output temperature of the boiler once a certain minimum flow rate has been exceeded, and may then operate the mixing valve within a closed loop control system.

On the other hand, the mixing valve may draw water from the store 50 at all hot water flow rates. This may be useful, particularly in a domestic environment, as a way of reducing fuel usage. Thus the boiler does not have to work so hard with warming hot water and the vessel is kept at temperature during the time when the boiler is working to provide space heating.

In alternative embodiments of the invention the mixing valve may be a thermostatic mixing valve that operates to regulate the water temperature to the inlet of the boiler to a target temperature, for example in the range of 25 to 30° C. It should be noted that where the storage vessel 50 and the mixing valve are placed before an unmodified boiler, then safety systems within the boiler may cause the boiler to shut down (or refuse to light) if the water inlet temperature to the boiler is too great.

Currently preferred embodiments of the invention using a thermostatic mixing valve seek to achieve mixing ratios of between 2:1 and 3:1 (cold water to hot water) to achieve boiler inlet temperatures of around 25° C. plus or minus a few degrees. Such mixing valves are readily available and give rise to simple but well behaved implementations of the present invention.

Figure 5:
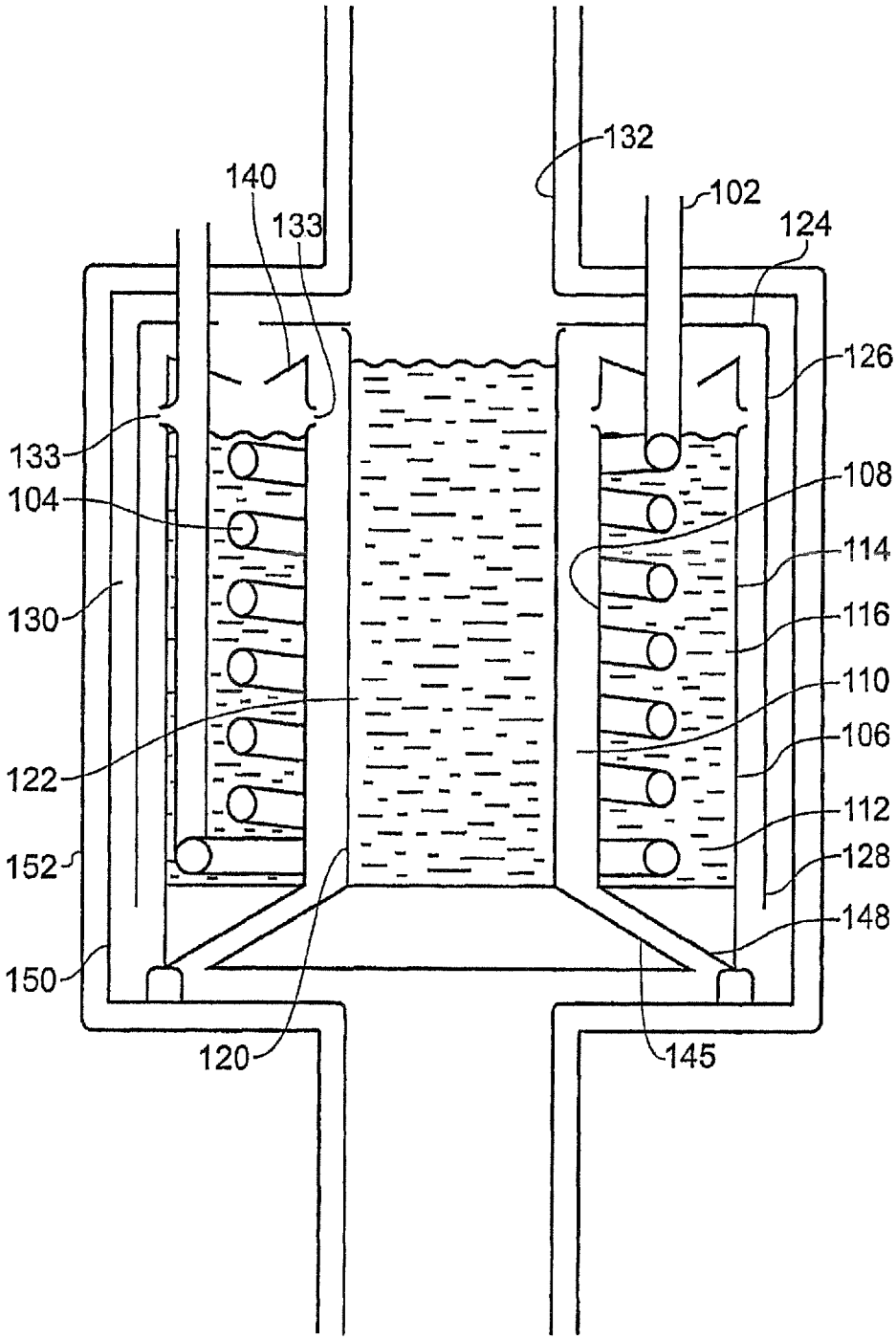
FIG. 5 schematically illustrates a heat recovery device that may be used to recover heat from the exhaust gas of the boiler.

FIG. 5 schematically illustrates a heat recovery unit for recovering heat from the flue gases which is suitable for use with the embodiments shown in FIG. 3 or 4 because the recovery device includes its own thermal storage capability.

The heat exchanger comprises a heat exchange pipe 102 which is bent into a helical coil portion 104 so as to provide a large pipe surface area within a compact volume. The helical portion 104 of the pipe is disposed within a double walled vessel 106. An inner wall 108 of the double walled vessel 6 defines a channel 110 which is open at both ends and through which hot gas flue gases can flow. A volume 112 defined between the inner wall 108 and an outer wall 114 of the double walled vessel 106 is filled with water 116 so as to form a thermal store.

A reservoir 120 having a closed lower end is coaxially disposed within the gas flow path. The reservoir 120 contains water 122 and hence the hot flue gases flowing along the channel 110 give out the heat to both the water 116 enclosed within the double walled vessel 106 and also the water 122 enclosed within the reservoir 120. A flange 124 extends radially outwards from the top of the reservoir 120 passing over the upper surface of the vessel 106 and joining with a further wall 126 which envelopes the exterior wall 114 of the vessel 106. The flange 124 and wall 126 serve to define a further gas flow path which now cause the hot flue gases from the boiler to travel over the top of the vessel 106 and then down the outside of the vessel 106 thereby giving further heat exchange possibilities. Once the gases reach the bottom most edge 128 of the wall 126 they are then allowed to enter into a further flue gas channel 130 which ducts the gases towards an exit pipe 132 of the heat exchanger.

Optionally apertures 133 can be formed in the walls 108 and 114 of the vessel 106. These allow the maximum level of water within the vessel 106 to be defined if, for a given boiler, it is desirable to have the amount of water reduced compared to the maximum volume of the vessel 106. Similarly apertures could be formed in the reservoir 120 to limit its maximum volume of water.

As the flue gases pass over the surfaces of the heat exchanger, the gas is cooled. This can give rise to the formation of condensation within the heat exchanger, and the point that this starts to form will vary depending on operating parameters of the boiler, external temperature, water temperature and so on. This condensation can be used to advantage. An uppermost wall 140 of the vessel 106 is dished so as to form a collecting region, and apertures are periodically formed in the dished wall 140 to allow condensation which collects on the wall 140 to flow into the interior of the vessel 106 thereby ensuring that the vessel 106 remains topped up with water whilst also allowing the vessel to remain vented, thereby avoiding any potential dangers from pressure build up should excessive heating occur. Similarly condensation occurring within the outlet pipe 132 can fall under gravity into the interior of the reservoir 120 thereby topping up the water level 122 ensuring that that secondary thermal store also remains continuously full.

Optionally, a diffuser may be provided in the inlet gas path from the boiler so as to ensure that the gas is equally distributed over the interior wall 108 of the vessel 106. The diffuser may be formed by an inclined wall 145 which may extend from or at least be in contact with the bottom surface of the reservoir 120. The vessel 106 may have its profile altered in order to form co-operating surfaces 148 thereby further enhancing heat transfer into the heat exchanger by virtue of heat flow across the surface 148. In an alternative embodiment the vessel 106 may rest upon a profiled ring which is chamfered so as to define the surface 148. The heat exchanger is enclosed within a housing 150 which itself may be further enclosed within a second housing 152 with the gap between the housing 150 and 152 defining an air inlet path for gases to the boiler, thereby ensuring that air admitted into the boiler for combustion is itself pre-warmed further enhancing the efficiency of the boiler, and also ensuring that the exterior surface of the heat exchanger remains cool, for example to the touch, since the boiler will be installed in a domestic environment.

Thus, as in the case shown in FIG. 3, even if water is not passing through the heat exchange coil the hot flue gases can give water up to the thermal stores within the flue gas heat recovery device.

It is possible to provide an inexpensive modification to the hot water system which enables a boiler to supply enhanced flow rates of hot water.

Although the invention has been described in the context of heat water, it is equally applicable for heating other fluids, such as food, oils, chemicals and so on.

This invention may also be used in multi-boiler installations where, while hot water is available from the storage vessel, it may be blended with cold water and used by two or more boilers to supply hot water. However, once the store of warmed water in the vessel 50 is depleted, one or more of the boilers may be tasked with re-warming it whilst the other boiler services the hot water draw in a conventional manner.

The invention claimed is:

1. A hot fluid system comprising:

a heater having an inlet and an outlet;

a storage vessel;

storage vessel heating means for heating the fluid in the storage vessel;

a mixing valve having a first inlet for receiving fluid to be heated from a fluid supply, a second inlet for receiving fluid from the storage vessel, and an outlet for supplying fluid to the inlet of the heater; and wherein the heater has a target output temperature, and when fluid is being drawn off, the mixing valve is adapted to blend the fluid from the fluid supply with fluid from the fluid storage vessel to obtain fluid at a mixing valve target temperature for supply to the fluid heater where the fluid is heated further to the target output temperature, and wherein the mixing valve target temperature is lower than the target output temperature.

2. A system as claimed in claim 1, in which the heater is a combustion heater and the storage vessel heating means recovers heat from flue gasses of the combustion heater.

3. A system as claimed in claim 1, further including a controller arranged to monitor the heater's performance and in which the controller is responsive to fluid temperature at the output of the mixing valve.

4. A system as claimed in claim 3, in which the controller is an integral part of the mixing valve.

5. A system as claimed in claim 1, in which the mixing valve is a thermostatically controlled mixing valve.

6. A system as claimed in claim 1, in which the heater is operable to heat fluid in the storage vessel.

7. A system as claimed in claim 1, in which the storage vessel heating means is a secondary heating system comprising one or more of electric heating, solar heating or waste heat recovery.

8. A hot water system comprising a system as claimed in claim 1.

9. A method of operating a liquid heating system, the heating system comprising:

a heater having an inlet and an outlet;

a storage vessel;

storage vessel heating means for heating liquid in the storage vessel; and a mixing valve having a first inlet for receiving liquid to be heated from a liquid supply, a second inlet for receiving liquid from the storage vessel, and an outlet for supplying liquid to the inlet of the heater, wherein the heater has a target output temperature and, when liquid is being drawn off, the mixing valve is adapted to blend liquid from the liquid supply with liquid from the storage vessel to obtain fluid at a mixing valve target temperature for supply to the heater where the fluid is heated to the target output temperature, and wherein the mixing valve target temperature is lower than the target output temperature.

10. A method as claimed in claim 9, in which the mixing valve is operated as a function of the heater flow rate demand.

11. A method as claimed in claim 9, in which the proportion of liquid drawn from the storage vessel increases with increasing flow rate demand on the heater.

12. A system as claimed in claim 1, wherein the heater gets its heat from other than the storage vessel.

* * * * *